US012595948B2

(12) United States Patent
Lee et al.

(10) Patent No.: US 12,595,948 B2
(45) Date of Patent: Apr. 7, 2026

(54) ICE MAKER, REFRIGERATOR, AND METHOD FOR CONTROLLING THE REFRIGERATOR

(71) Applicant: LG ELECTRONICS INC., Seoul (KR)

(72) Inventors: Donghoon Lee, Seoul (KR); Donghoon Lee, Seoul (KR); Wookyong Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 157 days.

(21) Appl. No.: 18/037,044

(22) PCT Filed: Jan. 12, 2022

(86) PCT No.: PCT/KR2022/000586
§ 371 (c)(1),
(2) Date: May 15, 2023

(87) PCT Pub. No.: WO2023/136371
PCT Pub. Date: Jul. 20, 2023

(65) Prior Publication Data

US 2024/0344750 A1 Oct. 17, 2024

(51) Int. Cl.
*F25C 1/24* (2018.01)
*F25C 1/25* (2018.01)

(52) U.S. Cl.
CPC ..... *F25C 1/24* (2013.01); *F25C 1/25* (2018.01); *F25C 2300/00* (2013.01)

(58) Field of Classification Search
CPC .... F25C 1/04; F25C 2400/10; F25C 2500/02; F25C 2400/06; F25C 2400/08; F25C 1/10;
(Continued)

(56) References Cited

U.S. PATENT DOCUMENTS 2,267,440 A * 12/1941 Carney ..... F25C 1/246 249/203
3,477,681 A * 11/1969 Moorman ..... F25C 1/246 249/72

(Continued)

FOREIGN PATENT DOCUMENTS

CN 110352326 6/2021
JP 2003-279210 10/2003

(Continued)

OTHER PUBLICATIONS

KR-20150040091-A English Translation (Year: 2015).*

(Continued)

*Primary Examiner* — Frantz F Jules
*Assistant Examiner* — Devon Moore
(74) *Attorney, Agent, or Firm* — KED & ASSOCIATES, LLP

(57) ABSTRACT

A refrigerator according to the present embodiment includes: a cabinet provided with a storage compartment; a door configured to open and close the storage compartment; and an ice maker configured to receive cold air for cooling the storage compartment so as to make ice, wherein the ice maker includes an ice tray comprising a plurality of ice-making cells configured to make ice, and the plurality of ice-making cells are arranged in a plurality of columns, each column comprising two or more ice-making cells, and bottom surfaces of the ice-making cells have different heights for each column.

20 Claims, 15 Drawing Sheets

(58) Field of Classification Search
CPC ..... F25C 2400/14; F25C 2500/06; F25C 1/22–1/246
USPC ..... 249/71, 203, 69
See application file for complete search history.

(56) References Cited

U.S. PATENT DOCUMENTS

| | | | | |
|---|---|---|---|---|
| 9,593,874 | B2 | 3/2017 | Brown et al. | |
| 10,551,107 | B2 * | 2/2020 | Sigmund | F25C 1/18 |

FOREIGN PATENT DOCUMENTS

| | | | | |
|---|---|---|---|---|
| KR | 10-0201854 | | 6/1999 | |
| KR | 10-2006-0098052 | | 9/2006 | |
| KR | 10-2010-0082127 | | 7/2010 | |
| KR | 20150040091 | A * | 4/2015 | F25C 1/24 |
| KR | 10-1519152 | | 5/2015 | |
| KR | 10-2019-0029877 | | 3/2019 | |
| KR | 10-2154524 | | 9/2020 | |
| WO | WO-2019111321 | A1 * | 6/2019 | F25C 1/10 |
| WO | WO-2020130473 | A1 * | 6/2020 | F25B 47/022 |

OTHER PUBLICATIONS

WO-2019111321-A1 English Translation (Year: 2019).*
International Search Report dated Sep. 28, 2022 issued in Application No. PCT/KR2022/000586.
Extended European Search Report dated Sep. 10, 2025 issued in Application No. 22920704.8.

* cited by examiner

ICE MAKER, REFRIGERATOR, AND METHOD FOR CONTROLLING THE REFRIGERATOR

CROSS-REFERENCE TO RELATED PATENT APPLICATIONS

This application is a U.S. National Stage Application under 35 U.S.C. § 371 of PCT Application No. PCT/KR2022/000586, filed Jan. 12, 2022, whose entire disclosures are hereby incorporated by reference.

TECHNICAL FIELD

The present specification relates to an ice maker, a refrigerator, and a method for controlling the refrigerator.

BACKGROUND ART

In general, a refrigerator is a home appliance for storing foods in an internal storage space, which is shield by a door, at a low temperature by low temperature air.

The refrigerator may cool the inside of the storage space by using cold air to store the stored food in a refrigerated or frozen state.

The refrigerator may be a side-by-side type refrigerator in which a freezing compartment and a refrigerating compartment are disposed at left and right sides, respectively, a top mount type refrigerator in which a freezing compartment is disposed above a refrigerating compartment, or a bottom freezer type refrigerator in which a refrigerating compartment is disposed above a freezing compartment.

In general, an ice maker for making ice is provided in a freezing compartment of a refrigerator. The ice maker makes ice by cooling water after accommodating the water supplied from a water supply source or a water tank into a tray. The ice made by the ice maker may be stored in the ice maker.

An ice making apparatus is disclosed in Korean Patent Publication No. 10-2006-0098052, which is a prior art document.

The ice making apparatus includes a tray having a plurality of upwardly opened cavities to make ice. A connection groove recessed in a thickness direction to connect the adjacent cavities to each other so that water easily moves when the water is supplied is defined in an upwardly opened region of each of the cavities.

However, according to the prior art document, when water is filled into the cavities after the water is completely supplied, the water may exist in the connection groove. In this case, there is a limitation in that the ice is also made in the connection groove after the ice is completely made so that two ice cubes are connected to each other, or a shape corresponding to the connection groove exists in the ice after the ice is separated.

DISCLOSURE OF THE INVENTION

Technical Problem

The present embodiment provides an ice maker in which water is distributed a plurality of ice-making cells without a water channel in an ice tray, a refrigerator, and a method for controlling the refrigerator.

Alternatively or additionally, the present embodiment provides an ice maker, in which water smoothly moves from an ice tray to an ice-making cell that is an ice-making cell disposed in an adjacent column in an ice tray, a refrigerator, and a method for controlling the refrigerator.

Alternatively or additionally, the present embodiment provides an ice maker, in which an ice-making speed increases, and ice is smoothly separated, a refrigerator, and a method for controlling the refrigerator.

Technical Solution

A refrigerator according to one aspect may include: a cabinet provided with a storage compartment; a door configured to open and close the storage compartment; and an ice maker configured to receive cold air for cooling the storage compartment so as to make ice.

The ice maker may include an ice tray comprising a plurality of ice-making cells configured to make ice, wherein the plurality of ice-making cells may be arranged in a plurality of columns, each column comprising two or more ice-making cells, and bottom surfaces of the ice-making cells may have different heights for each column.

The ice maker may be provided in, for example, the door. An additional ice maker for making ice having a shape different from that of the ice maker may be further provided in the door. The ice maker may be disposed above the additional ice maker.

The ice tray may include: a first wall configured to define a first ice-making cell; a second wall configured to define a second ice-making cell that is adjacent to the first ice-making cell; and a third wall configured to define a third ice-making cell that is adjacent to the second ice-making cell. The second wall may be disposed between the first wall and the third wall.

A bottom surface of the second wall may be disposed lower than a bottom surface of the first wall, and a bottom surface of the third wall may be disposed lower than the bottom surface of the second wall.

The ice tray may further include a first connection portion configured to connect the first wall to the second wall. The ice tray may further include a second connection portion configured to connect the second wall to the third wall.

An upper end of the second connection portion may have a height less than that of an upper end of the first connection portion.

The ice made in the first ice-making cell may have the same height as a height from the bottom surface of the first wall to the first connection portion.

The ice made in the first ice-making cell may have the same height as a height from the bottom surface of the second wall to the second connection portion.

The ice tray may further include a partition wall configured to partition two ice-making cells, which are adjacent to each other in each column. An upper end of the partition wall may be disposed higher than each of the first connection portion and the second connection portion.

One side of the partition wall may include a first side surface spaced apart from the first wall. A lower end of the first side surface may be connected to the first wall by the first connection surface. The first side surface, the first wall, and the first connection surface may be configured to define a first passage.

The first connection portion may be disposed lower than the upper end of the partition wall. The first connection portion may be disposed higher than an upper end of the first connection portion.

The other side of the partition wall may include a second side surface spaced apart from the third wall. A lower end of the second side surface may be connected to the third wall by the second connection surface. The second side surface, the third wall, and the second connection surface may be configured to define a second passage.

The second connection surface may be disposed lower than an upper end of the second connection portion.

The ice tray may further include a first blocking wall extending upward from an opposite side of the first connection portion on the first wall. The ice tray may further include a second blocking wall extending upward from an opposite side of the second connection portion on the third wall.

An upper end of the first may have a height greater than that of an upper end of the second blocking wall.

The upper end of each of the first blocking wall and the second blocking wall may be disposed higher than an upper end of the partition wall.

In an arrangement direction of the ice-making cells in each column, each of top surfaces of the first connection portion and the second connection portion may be provided in a straight-line shape in an arrangement direction of the ice-making cells in each column.

Alternatively, in an arrangement direction of the ice-making cells in each column, a central portion of each of the top surfaces of the first connection portion and the second connection portion is disposed lower than each of both ends of each of the top surfaces in an arrangement direction of the ice-making cells in each column.

An ice maker according to another aspect may include: an ice tray comprising a plurality of ice-making cells configured to make ice; and a driving portion configured to rotate the ice tray.

The plurality of ice-making cells may be arranged in a plurality of columns, each column comprising two or more ice-making cells, and bottom surfaces of the ice-making cells may have different heights for each column.

A method for controlling a refrigerator according to further another aspect may include an ice tray configured to receive cold air for cooling the storage compartment so as to make ice and provided with a plurality of ice-making cells, wherein the plurality of ice-making cells are arranged in a plurality of columns, each cell comprises two or more ice-making cells, is provided.

The method may include: supplying water to the ice tray; rotating the ice tray at a set angle or for a set time in a first direction after completing the supply of the water; and rotating the ice tray in a direction opposite to the first direction to allow the ice tray to return to an initial position after completing the rotating of the ice tray.

The bottom surface of the ice-making cell may have different heights for the plurality of columns.

The ice tray may include: a first wall configured to define a first ice-making cell; a second wall configured to define a second ice-making cell that is adjacent to the first ice-making cell; and a third wall configured to define a third ice-making cell that is adjacent to the second ice-making cell.

A bottom surface of the second wall may be disposed lower than a bottom surface of the first wall, and a bottom surface of the third wall may be disposed lower than the bottom surface of the second wall.

The first direction may be a direction in which the bottom surface of the first wall has a gradually decreasing height, and the bottom surface of the third wall has a gradually increasing height.

The method may further include waiting for a first reference time after supplying the water. After waiting for the first reference time, the ice tray may be rotated in the first direction.

The method may further include waiting for a second reference time after rotating the ice tray. After waiting for the second reference time, the ice tray may be rotated in a second direction.

The rotating of the ice tray and the allowing the ice tray to return to the initial position may be performed two or more times.

A method for controlling a refrigerator according to further another aspect may include: supplying water to the ice tray; rotating the ice tray at a first angle in a first direction after completely supplying the water; rotating the ice tray at a second angle in a second direction opposite to the first direction; and rotating the ice tray at a third angle in the first direction to allow the ice tray to return to an initial position.

The first angle, the second angle, and the third angle may be determined by controlling the rotating time of the ice tray.

The second angle may be greater than the first angle.

The ice tray may include: a first wall configured to define a first ice-making cell; a second wall configured to define a second ice-making cell that is adjacent to the first ice-making cell; and a third wall configured to define a third ice-making cell that is adjacent to the second ice-making cell. A bottom surface of the second wall may be disposed lower than a bottom surface of the first wall, and a bottom surface of the third wall may be disposed lower than the bottom surface of the second wall.

The first direction may be a direction in which the bottom surface of the third wall has a gradually decreasing height, and the bottom surface of the first wall has a gradually increasing height.

The method may further include waiting for a first reference time after supplying the water, wherein, after waiting for the first reference time, the ice tray may be rotated in the first direction.

The method may further include waiting for the second reference time after the ice tray is rotated at a first angle in the first direction.

The method may further include waiting for the third reference time after the ice tray is rotated at a second angle in the second direction.

A refrigerator according to further another aspect may include: a cabinet provided with a storage compartment; a door configured to open and close the storage compartment; and an ice maker configured to receive cold air for cooling the storage compartment so as to make ice, wherein the ice maker includes: an ice tray including a plurality of ice-making cells configured to make ice; and a driving portion configured to rotate the ice tray. The plurality of ice-making cells may be arranged in a plurality of columns, and each column may include two or more ice-making cells.

The bottom surface of the ice-making cell may have different heights for the plurality of columns.

The driving portion may be controlled so that the ice tray is rotated at a set angle or for a set time in the first direction after the water is completely supplied. The driving portion may be controlled so that the ice tray is rotated in a direction that is opposite to the first direction to return to an initial position after the ice tray is completely rotated.

A refrigerator according to further another aspect may include: a cabinet provided with a storage compartment; a door configured to open and close the storage compartment; and an ice maker configured to receive cold air for cooling the storage compartment so as to make ice, wherein the ice maker includes: an ice tray including a plurality of ice-making cells configured to make ice; and a driving portion configured to rotate the ice tray, wherein the plurality of ice-making cells are arranged in a plurality of columns, each column including two or more ice-making cells, and bottom surfaces of the ice-making cells may have different heights for each column, wherein the driving portion is controlled so that the ice tray is rotated at a first angle in the first direction after the water is completely supplied. The driving portion may be controlled so that the ice tray is rotated at a second angle in a second direction that is opposite to the first direction after the ice tray is completely rotated in the first direction. The driving portion may be controlled so that the ice tray is rotated at a third angle in the first direction to return to an initial position after the ice tray is completely rotated in the second direction. The bottom surface of the ice-making cell may have different heights for the plurality of columns.

The second angle may be greater than the first angle.

Advantageous Effects

According to the present embodiment, the water may be distributed to the plurality of ice-making cells without the water channel in the ice tray.

In addition, the water may smoothly move to the ice-making cell that is disposed in the adjacent column in the ice tray.

In addition, even if the refrigerator is installed to be inclined, the water may be evenly distributed to the plurality of ice-making cells.

In addition, since the ice making speed increases, and the made ice cubes are not connected to each other, the ice may be smoothly separated.

MODE FOR CARRYING OUT THE INVENTION

Figure 1:
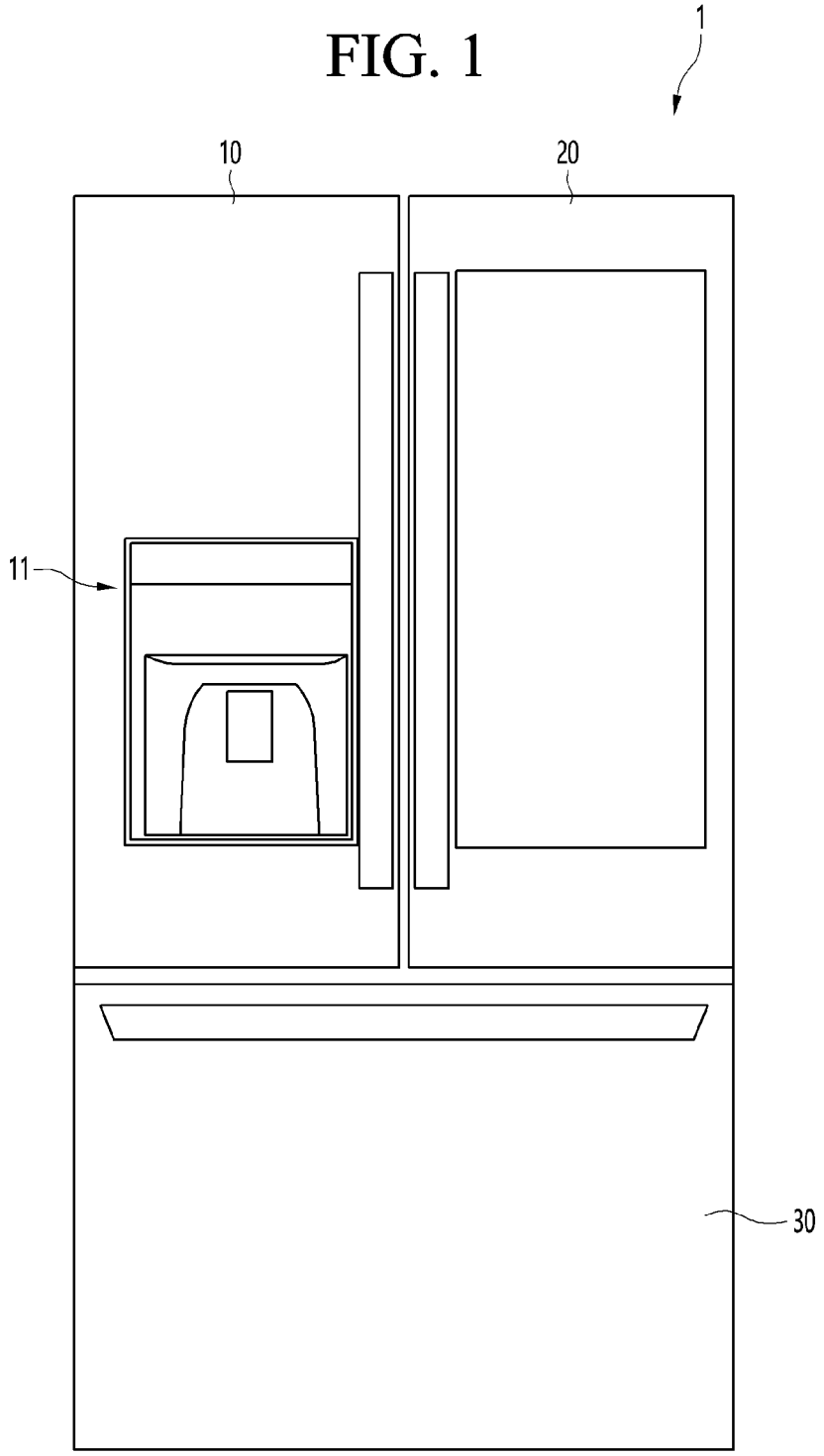
FIG. 1 is a front view of a refrigerator according to a first embodiment of the present invention.

Hereinafter, some embodiments of the present invention will be described in detail with reference to the accompanying drawings. In adding of reference numerals to components of each drawing, it should be noted that the same components have the same numerals as much as possible even if the components are displayed on different drawings. In addition, in describing the embodiments of the present invention, if it is determined that a detailed description of a related known configuration or function disturbs understanding of the embodiment of the present invention, the detailed description will be omitted.

Also, in the description of the embodiments of the present invention, the terms such as first, second, A, B, (a) and (b) may be used. These terms are only used to distinguish the component from other components, and the essence, sequence, or order of the corresponding component is not limited by the term. It should be understood that when an element is described as being "connected," "coupled", or "joined" to another element, the former may be directly connected or jointed to the latter or may be "connected", coupled" or "joined" to the latter with a third component interposed therebetween.

Figure 2:
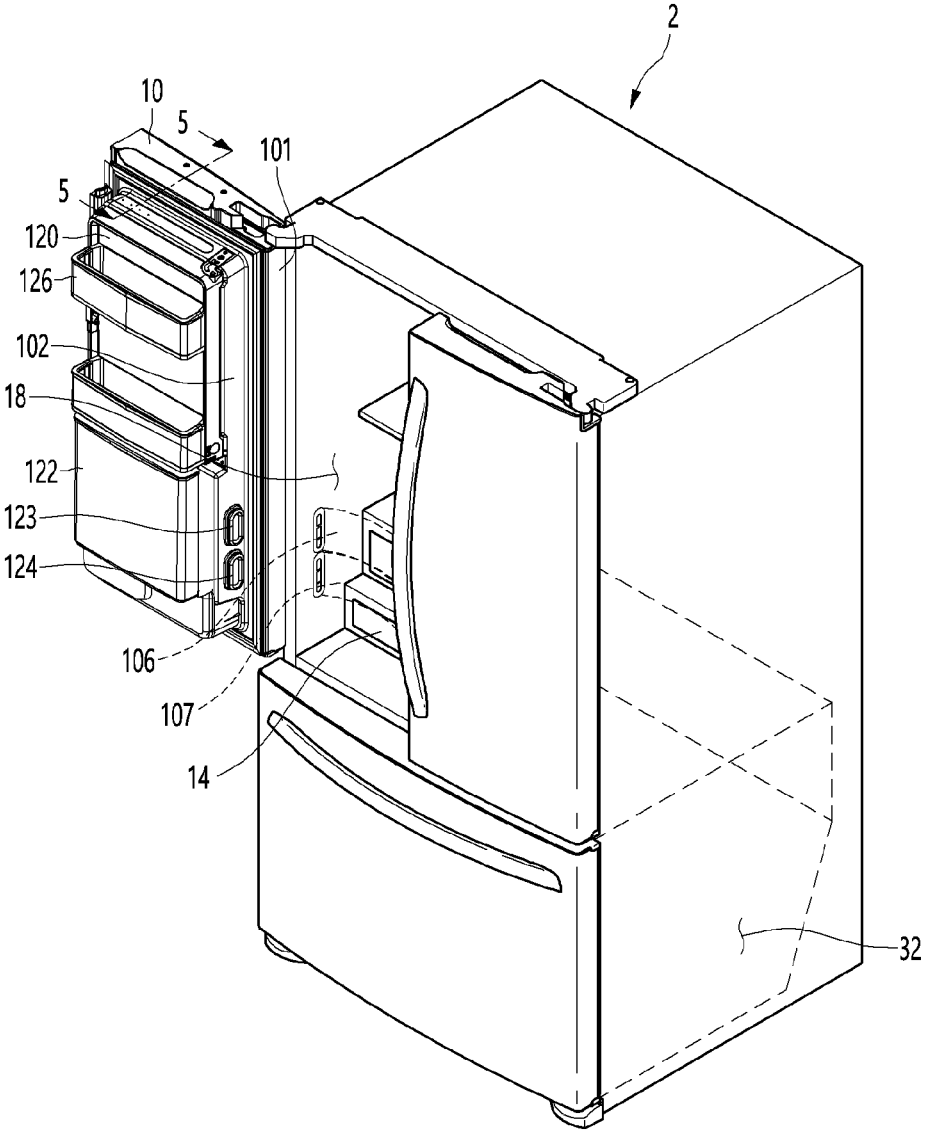
FIG. 2 is a view illustrating a state in which one door of the refrigerator of FIG. 1 is opened.

FIG. 1 is a front view of a refrigerator according to a first embodiment of the present invention, and FIG. 2 is a view illustrating a state in which one door of the refrigerator of FIG. 1 is opened.

Figure 3:
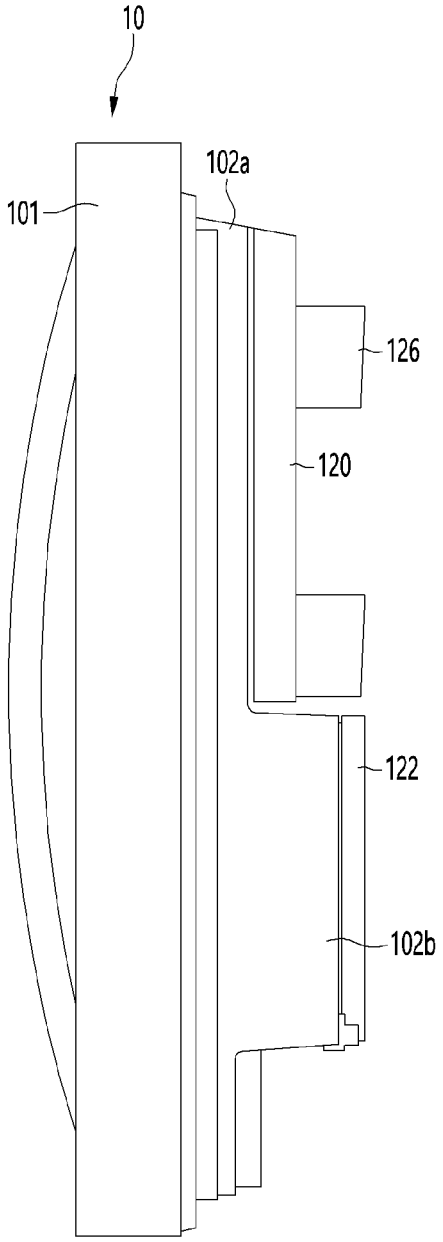
FIG. 3 is a side view of a refrigerating compartment door according to the first embodiment of the present invention.
Figure 4:
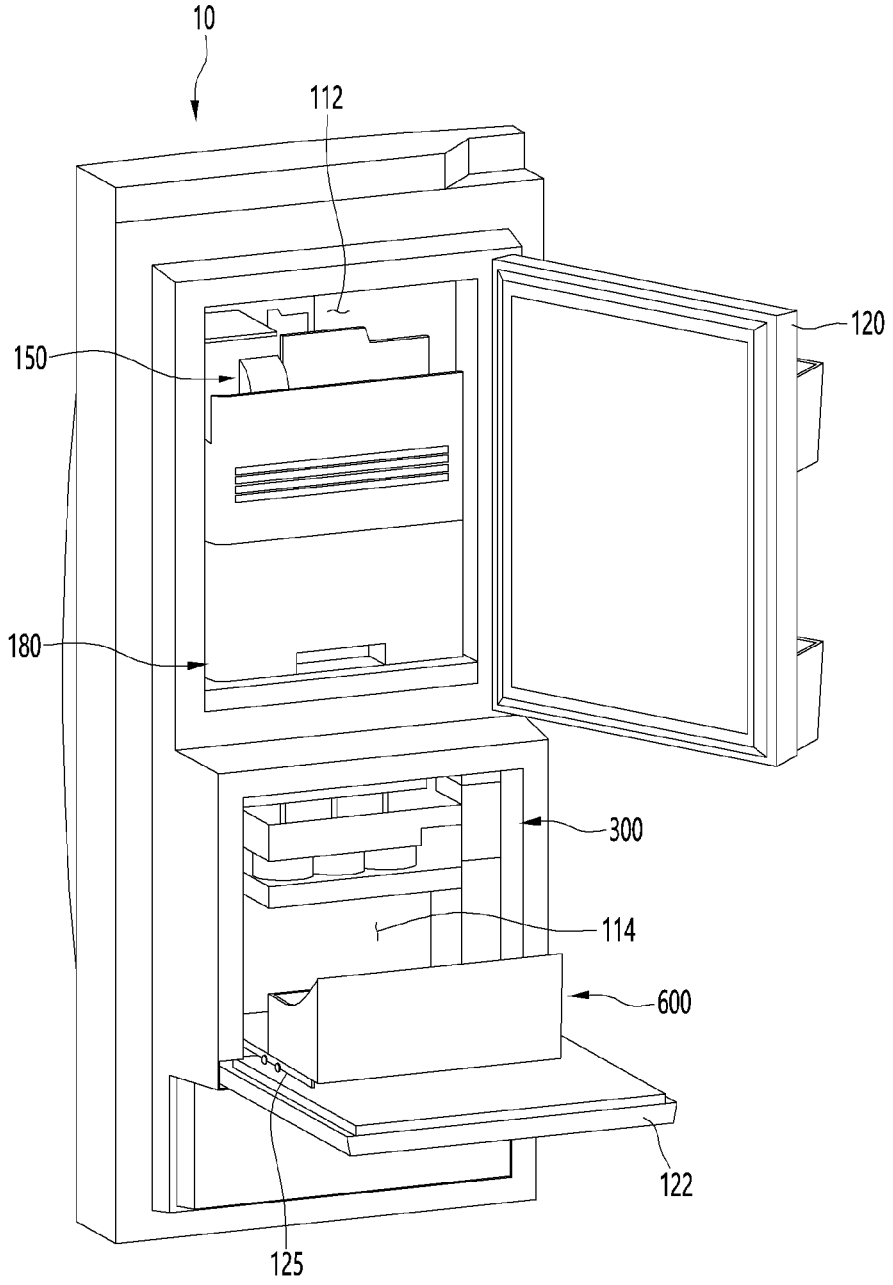
FIG. 4 is a view illustrating a state in which a plurality of ice-making chambers of the refrigerating compartment door are opened.
Figure 5:
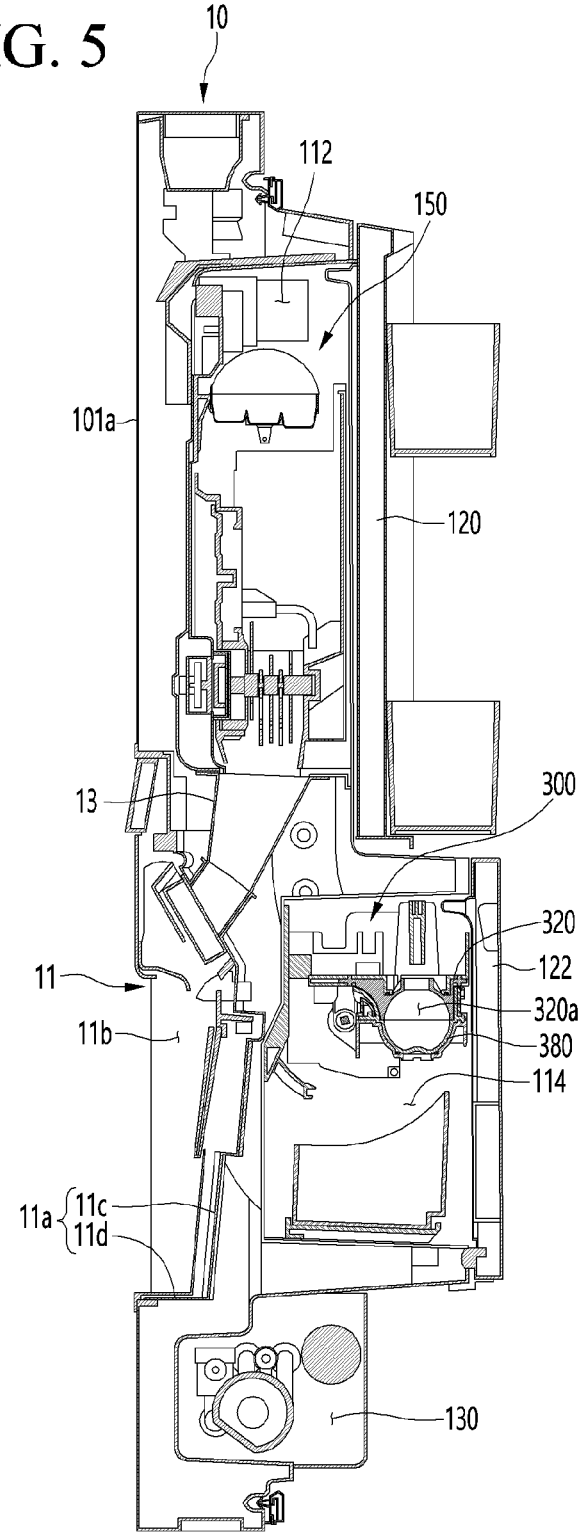
FIG. 5 is a cross-sectional view taken along line 5-5 of FIG. 2.

FIG. 3 is a side view of a refrigerating compartment door according to the first embodiment of the present invention, FIG. 4 is a view illustrating a state in which a plurality of ice-making chambers of the refrigerating compartment door are opened, and FIG. 5 is a cross-sectional view taken along line 5-5 of FIG. 2.

Referring to FIGS. 1 to 5, a refrigerator 1 according to the present embodiment may include a cabinet 2 having a storage compartment (or storage space) and a door that opens and closes the storage compartment.

The storage compartment may include at least one of a refrigerating compartment 18 and a freezing compartment 32 disposed below the refrigerating compartment 18.

The refrigerating compartment 18 may be opened and closed by one or more refrigerating compartment doors 10 and 20. The freezing compartment 32 may be opened and closed by one or more freezing compartment doors 30.

For example, the refrigerating compartment 18 may be opened and closed by a first refrigerating compartment door 10 and a second refrigerating compartment door 20.

One or more refrigerating compartment doors 10 and 20 may include one or more ice makers. As an example, FIG. 4 illustrates that the first refrigerating compartment door 10 includes a plurality of ice makers 150 and 300. However, it is not limited thereto, and the second refrigerating compartment door 20 may include a plurality of ice makers 150 and 300.

Alternatively, it is also possible that one or more ice makers exist in one or more refrigerating compartment doors 10 and 20, and one or more ice makers are provided in the freezing compartment.

Although a bottom freezer type refrigerator is exemplarily illustrated in FIG. 2, unlike this, it is revealed that the spirit of the present invention may be equally applied to a side-by-side type refrigerator or a top mount type refrigerator.

In the case of the side-by-side or top mount type refrigerator, the freezing compartment door may include a plurality of ice makers, or the refrigerating compartment door may include a plurality of ice makers.

Hereinafter, for convenience of description, it is referred to as "the refrigerator compartment door 10 including the plurality of ice makers 150 and 300".

The refrigerating compartment door 10 may include a dispenser 11 configured to dispense ice made in at least one of the plurality of ice makers 150 and 300. The dispenser 11 is disposed in front of the refrigerating compartment door 10, and a portion of the dispenser 11 is recessed backward to provide a space in which a container is capable of being placed.

The plurality of ice makers 150 and 300 may be arranged in a vertical direction. For example, the plurality of ice makers 150 and 300 may include a first ice maker 150 and a second ice maker 300 disposed below the first ice maker 150. Of course, the present embodiment does not exclude that the plurality of ice makers 150 and 300 are disposed in a lateral direction.

In the present specification, when the refrigerating compartment door 10 includes one ice maker, the refrigerating compartment door 10 may include only the first ice maker 150.

The dispenser 11 may dispense ice made in at least the first ice maker 150. Thus, the first ice maker 150 may be disposed higher than the dispenser 11.

When the dispenser 11 dispenses the ice made in the second ice maker 300, the second ice maker 300 may also be disposed higher than the dispenser 11.

The refrigerator compartment door 10 may include an outer case 101 configured to define an outer appearance of a front surface thereof and a door liner 102 coupled to the outer case 101. The door liner 102 may open and close the refrigerating compartment 18.

In a state in which the outer case 101 and the door liner 102 are coupled to each other, a heat insulation space may be defined in a space between the outer case 101 and the door liner 102, and a heat insulating material may be provided in the heat insulation space.

The door liner 102 may define a plurality of ice-making chambers 112 and 114 in which the plurality of ice makers 150 and 300 are disposed.

The plurality of ice-making chambers 112 and 114 may be provided in such a manner that one surface of the door liner 102 is recessed toward the outer case 101.

The plurality of ice-making chambers 112 and 114 may include a first ice-making chamber 112 in which the first ice maker 150 is accommodated and a second ice-making chamber 114 in which the second ice maker 300 is accommodated.

The plurality of ice-making chambers 112 and 114 may be arranged in the vertical direction or in the lateral direction. As an example, FIG. 4 illustrates that the plurality of ice-making chambers 112 and 114 are arranged in the vertical direction.

The refrigerator compartment door 10 may further include a first ice bin 180 in which ice made by the first ice maker 150 is stored. The refrigerator compartment door 10 may further include a second ice bin 600 in which ice made by the second ice maker 300 is stored.

The first ice bin 180 may be accommodated in the first ice-making chamber 112 together with the first ice maker 150. The second ice bin 600 may be accommodated in the second ice-making chamber 114 together with the second ice maker 300.

Cold air generated by a cooler may be supplied to the ice-making chambers 112 and 114. For example, cold air for cooling the freezing compartment 32 may be supplied to the ice-making chambers 112 and 144.

Thus, the refrigerator 1 may include: a supply passage 106 to guide cold air in the freezing compartment or cold air in a space, in which an evaporator generating cold air for cooling the freezing compartment 32 is disposed, to the refrigerating compartment door 10; and a discharge passage 107 to guide cold air discharged from the refrigerating compartment door 10 to the freezing compartment 32 or the space in which the evaporator is disposed.

The refrigerator compartment door 10 may include a cold air inlet 123 and a cold air outlet 124. When the refrigerating compartment door 10 is closed, the cold air inlet 123 may communicate with the supply passage 106, and the cold air outlet 124 may communicate with the discharge passage 107.

The cold air inlet 123 and the cold air outlet 124 may be provided in a side surface of the door liner 102. Although not limited, the side surface of the door liner 102 may be a surface facing a wall of the refrigerating compartment 18, in which the supply passage 106 and the discharge passage 107 are disposed when the refrigerating compartment door 10 is closed.

A shape of ice made in the first ice maker 150 may be different from that of ice made in the second ice maker 300. For example, the second ice maker 300 may make spherical ice.

In the present specification, the "spherical shape" refers to a geometrically spherical shape as well as a shape similar to a spherical shape.

Alternatively, transparency of the ice made in the first ice maker 150 may be different from that of the ice made in the second ice maker 300. For example, the transparency of ice made in the second ice maker 300 may be higher than that of ice made in the first ice maker 150.

Alternatively, a size (or volume) of the ice made in the first ice maker 150 and a size (or volume) of the ice made in the second ice maker 300 may be different from each other. For example, the size (or volume) of the ice made in the second ice maker 300 may be greater than that of the size (or volume) of the ice made in the first ice maker 150.

Alternatively, a structure of the first ice maker 150 for making ice and a manner for separating the made ice may be different from a structure of the second ice maker 300 and a manner for separating the made ice in the second ice maker 300.

Due to the difference in structure and ice-separation manner, a shape of the first ice-making chamber 112 in which the first ice maker 150 is disposed is different from that of the second ice-making chamber 114 in which the second ice maker 300 is disposed.

For example, a depth (horizontal length) of the second ice-making chamber 114 may be greater than a depth (horizontal length) of the first ice-making chamber 112.

Due to the depth difference between the ice-making chambers 112 and 114, the side surface of the door liner 102 may include a first side surface portion 102*a* and a second side surface portion 102*b* that have different widths in a front to rear direction.

A width of the second side portion 102*b* may be larger than that of the second side portion 102*a*. Due to the difference in width between the side surface portions 102*a* and 102*b*, a thickness of the refrigerating compartment door 10 at a portion at which the second ice maker 300 is disposed is greater than that of the refrigerating compartment door 10 in the front to rear direction at a portion at which the first ice maker 150 is disposed.

The cold air inlet 123 and the cold air outlet 124 may be provided in the second side surface portion 102*b* of the door liner 102.

For example, referring to FIGS. 2 and 3, the second side portion 102*b* may protrude further toward the refrigerating compartment 18 than the first side portion 103*a*.

Since the refrigerator compartment door 10 defines the ice-making chambers 112 and 114, the refrigerator compartment door 10 may further include a plurality of ice-making chamber doors 120 and 122 that open and close the plurality of ice-making chambers 112 and 114 to thermally insulate the ice-making chambers 112 and 114, respectively.

The plurality of ice-making chamber doors 120 and 122 may include a first ice-making chamber door 120 that opens and closes the first ice-making chamber 112 and a second ice-making chamber door 122 that opens and closes the second ice-making chamber 114.

The plurality of ice-making chamber doors 120 and 122 may partition the ice-making chambers 112 and 114 from the refrigerating compartment 18. Each of the plurality of ice-making chamber doors 120 and 122 may include a heat insulating material. Thus, heat transfer between the refrigerating compartment 18 and the ice-making chambers 112 and 114 may be minimized by the plurality of ice-making chamber doors 120 and 122.

Each of the ice-making chamber doors 120 and 122 may be rotatably connected to the refrigerating compartment door 10 by, for example, a hinge.

Rotational directions of the first ice-making chamber door 120 and the rotational direction of the second ice-making chamber door 122 may be different from each other. For example, the first ice-making chamber door 120 may be rotated based on a rotation center extending in a first direction, and the second ice-making chamber door 122 may be rotated based on a rotation center extending in a second direction crossing the first direction. Although not limited, the first direction may be a vertical direction, and the second direction may be a horizontal direction.

When the rotation center of the second ice-making chamber door 122 extends in the horizontal direction, the rotation center of the second ice-making chamber door 122 may be provided by the hinge disposed on a lower portion of a side surface of the second ice-making chamber door 120. Thus, an upper side of the second ice-making chamber door 122 may be rotated with respect to the hinge disposed at a lower side.

The refrigerator compartment door 10 may further include a draw-out unit 125 configured to draw at least a portion of the second ice bin 600 out of the second ice-making chamber 122 while the second ice-making chamber door 122 is opened.

One side of the draw-out unit 125 may be connected to the second ice-making chamber door 122, and the other side may be directly or indirectly connected to the second ice bin 600.

For example, the draw-out unit 125 may include one or more links. When the second ice-making chamber door 122 is opened, the second ice bin 600 may be disposed above the second ice-making chamber door 122. For example, the second ice bin 600 may be directly or indirectly supported by the second ice-making chamber door 122.

A basket 126 capable of storing food may be connected to the first ice-making chamber door 120 due to the difference in thickness of the refrigerating compartment door 10.

In the present embodiment, since the rotation center of the first ice-making chamber door 120 extends in the vertical direction, the first ice-making chamber door 120 is rotatable in the horizontal direction. Therefore, while the first ice-making chamber door 120 is rotated, the food may be stably stored in the basket 126.

Referring to FIG. 3, in a state where the basket 126 is installed on the first ice-making chamber door 120, at least a portion of the basket 126 may overlap the second ice-making chamber 114 in the vertical direction. In the state where the basket 126 is installed on the first ice-making chamber door 120, at least a portion of the basket 126 may overlap the second ice maker 120 in the vertical direction. In the state where the basket 126 is installed on the first ice-making chamber door 120, and the second ice-making chamber door 122 is closed, at least a portion of the basket 126 may overlap the second ice bin 600 in the vertical direction. In the state where the basket 126 is installed on the first ice-making chamber door 120, and the second ice-making chamber door 122 is closed, at least a portion of the basket 126 may overlap the second ice-making chamber door 122 in the vertical direction.

Referring to FIG. 5, the second ice maker 300 may include a first tray 320 and a second tray 380. Each of the first tray 320 and the second tray 380 may define an ice-making cell 320*a*. The second tray 380 may be rotated with respect to the first tray 320.

Water may be supplied to the second tray 380 when the second tray 380 is at a water supply position, and after the water supply is completed, the second tray 380 may move or be rotated to an ice-making position. At least a portion of the second tray 380 may be spaced apart from at least a portion of the first tray 320 at the water supply position. The portion of the second tray 380, which is spaced apart from the first tray 320, at the water supply position, may be in contact with the first tray 320 at the ice-making position to completely define the ice-making cell 320*a*.

The dispenser 11 may include a dispenser housing 11*a* defining a cavity 11*b*. The dispenser housing 11*a* may be coupled to, for example, the outer case 101. The cavity 11*b* may be recessed backward from a front surface 101*a* of the refrigerator door 10.

At least a portion of the dispenser 11 may be disposed to overlap the second ice-making chamber 114 in the front and rear direction. For example, at least a portion of the second ice-making chamber 114 may be disposed between a recessed wall 11*c* of the dispenser housing 11*a* and the second ice-making chamber door 122.

The shortest horizontal distance between the front surface 101*a* of the refrigerator door 10 and the second ice-making chamber 114 may be greater than the shortest horizontal distance between the front surface 101*a* of the refrigerator door 10 and the first ice-making chamber 112 by the dispenser housing 11*a*. A width (or depth) of the first ice-making chamber 112 in the front to rear direction may be less than a width (or depth) of the second ice-making chamber 114 in the front to rear direction.

A vertical length of the first ice-making chamber 112 may be greater than a vertical length of the second ice-making chamber 114. At least a portion of the second ice-making chamber 114 may overlap the first ice-making chamber 112 in the vertical direction.

An accommodation chamber 130 in which at least one of a filter configured to purify water or a water tank configured to store water may be provided below the second ice-making chamber 114.

At least portions of the first ice-making chamber 112, the second ice-making chamber 114, and the accommodation chamber 130 may overlap each other in the vertical direction.

An ice chute 13 may be disposed below the first ice-making chamber 112. The ice chute 13 may guide the ice discharged from the first ice bin 180 to the dispenser 11. The ice chute 13 may overlap at least a portion of the first ice-making chamber 112 in the vertical direction. At least a portion of the ice chute 13 may overlap the second ice-making chamber 114 in the vertical direction.

At least a portion of the ice chute 13 may overlap the accommodation chamber 130 in the vertical direction. A vertical center line of the ice-making cell 320*a* of the second ice maker 300 may not pass through the first ice-making chamber 112 at the ice-making position of the second tray 380. The vertical center line of the ice cell 320*a* of the second ice maker 300 may be disposed outside the first ice-making chamber 112.

The ice-making cell 320*a* of the second ice-maker 300 may be disposed so as not to overlap the first ice-making chamber 112 in the vertical direction at the ice-making position of the second tray 380. The ice-making cell 320*a* of the second ice maker 300 may overlap the basket 126 in the vertical direction.

The vertical center line of the ice-making cell 320*a* of the second ice maker 300 may not pass through the accommodation chamber 130 at the ice-making position of the second tray 380. The ice-making cell 320*a* of the second ice maker 300 may be disposed so as not to overlap the accommodation chamber 130 in the vertical direction. That is, the vertical center line of the ice-making cell 320*a* of the second ice maker 300 may be disposed outside the accommodation chamber 130.

The ice-making cell 320*a* may be disposed lower than the ice chute 13 and higher than a bottom wall 11*d* of the dispenser housing 11*a* at the ice-making position of the second tray 380. Here, the ice-making cell 320*a* may be disposed closer to the ice chute 13 than the bottom wall 11*d* of the dispenser housing 11*a*.

For example, the second tray 380 may be rotated in a clockwise direction with reference to FIG. 5 to move to the ice-separation position. The second tray 380 may overlap at least a portion of the first ice-making chamber 112 in the vertical direction at the ice-separation position of the second tray 380. The second tray 380 may overlap at least a portion of the accommodation chamber 130 in the vertical direction at the ice-separation position of the second tray 380. At least a portion of the second tray 380 may overlap the ice chute 13 in the vertical direction at the ice-separation position of the second tray 380.

Figure 6:
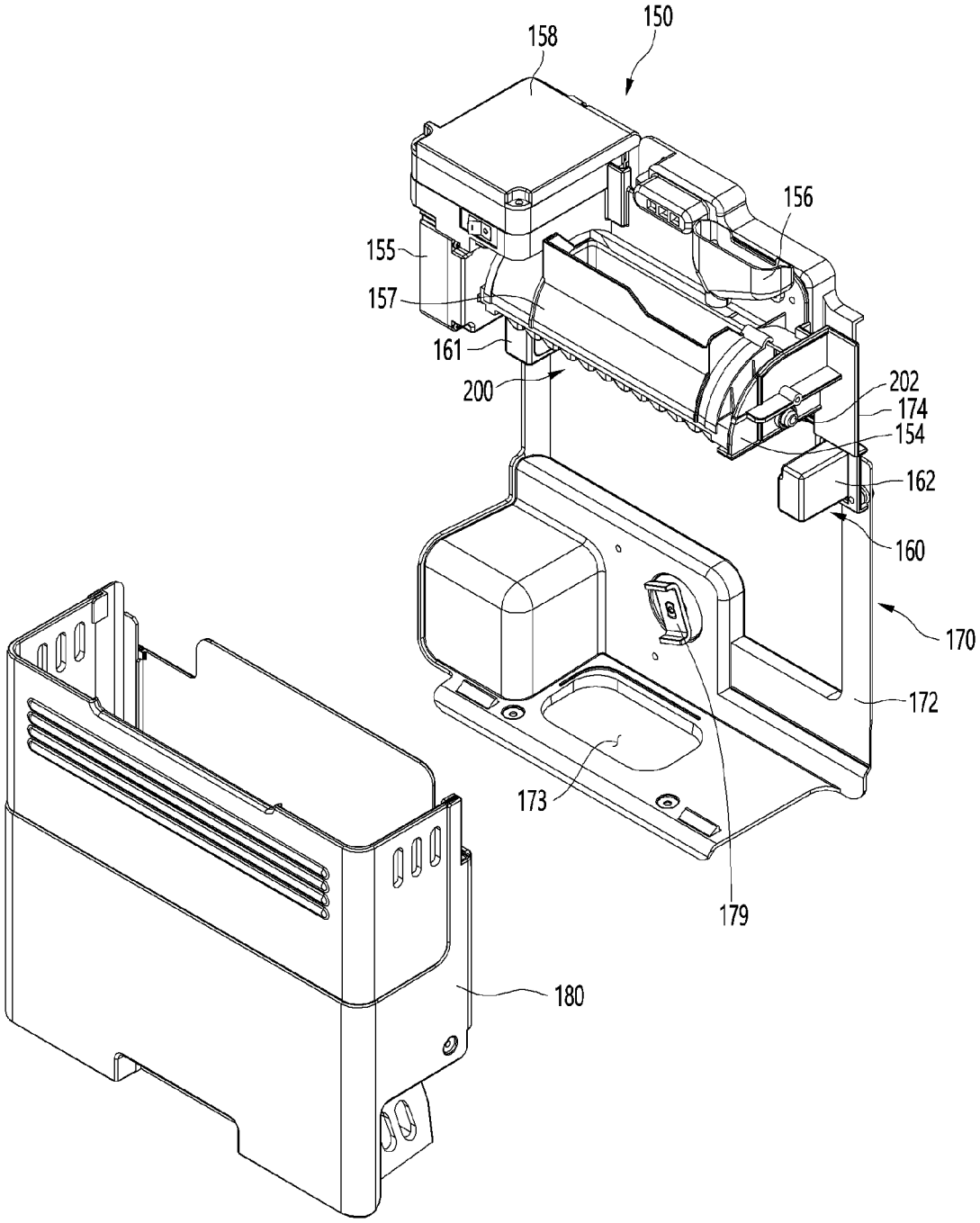
FIG. 6 is a perspective view of a first ice maker and a first ice bin according to the first embodiment of the present invention.

FIG. 6 is a perspective view of the first ice maker and the first ice bin according to the first embodiment of the present invention.

Referring to FIG. 6, the first ice maker 150 may include an ice tray 200 defining the ice-making cell.

The first ice maker 150 may further include a driving portion 158 that provides power to automatically rotate the ice tray 200 so as to separate ice from the ice tray 200, and a power transmission portion 155 that transmits the power of the driving portion 158 to the ice tray 200.

The first ice maker 150 may further include a tray cover 157 that cover the ice tray 200 to prevent water from overflowing when the water is supplied to the ice tray 200. The first ice maker 150 may further include a water supply portion 156 that guides the water to the ice tray 200.

The ice tray 200 may include a plurality of ice-making cells. Water discharged from the water supply portion 156 to drop into the ice tray 200 may be distributed to the plurality of ice-making cells.

The first ice maker 150 may further include a support bracket 170 provided with a support wall 154 that supports the ice tray 200. The support bracket 170 may include a first support 172 and a second support 174 coupled to the first support 172 or integrated with the first support 172.

The first support 172 may support the first ice bin 180. An ice opening 173 through which ice discharged from the first ice bin 180 passes may be defined in the first support 172.

A shaft 202 that rotates the ice tray 200 may be rotatably supported on the support wall 154. For example, the support wall 154 may be provided on the second support 174.

The support bracket 170 may further include a transmission portion 179 that transmits power of a motor assembly (not shown) to the first ice bin 180.

A full-ice detection mechanism 160 that detects whether the first ice bin 180 is full with ice may be provided in the support bracket 170. The full-ice detection mechanism 160 may be installed on the second support 174 at a position spaced apart from the ice tray 200. The full-ice detection mechanism 160 may be disposed below the ice tray 200.

The full-ice detection device 160 may include a transmitter 161 that transmits a signal, and a receiver 162 spaced apart from the transmitter 161 to receive a signal of the transmitter 161. When light transmitted from the transmitter 161 reaches the receiver 162, it may be determined that the full ice has not been detected. On the other hand, if the receiver 162 does not receive the light transmitted from the transmitter 161, or an amount of light received by the receiver 162 is less than an amount of reference light, it may be determined that the full ice has been detected.

Alternatively, the full-ice detection mechanism 160 may include a rotable lever. The lever may be rotated from a waiting position to a full-ice detection position. When the lever is rotatable to the full-ice detection position, it may be determined that full-ice has not been detected. On the other hand, when the lever is not rotated to the full-ice detection position, it may be determined that full-ice has been detected. Since the full-ice detection mechanism 160 is implemented by the known technology, a detailed description thereof will be omitted.

Figure 7:
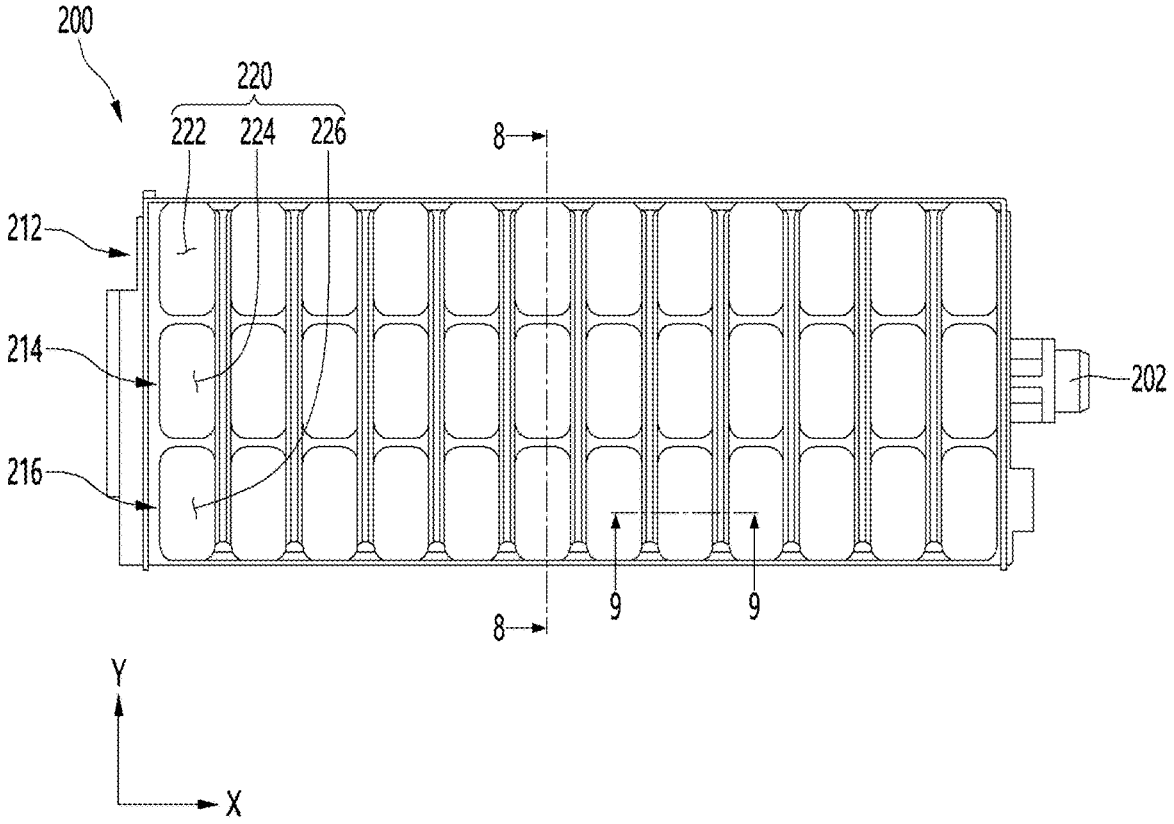
FIG. 7 is a plan view of an ice tray according to the first embodiment of the present invention.
Figure 8:
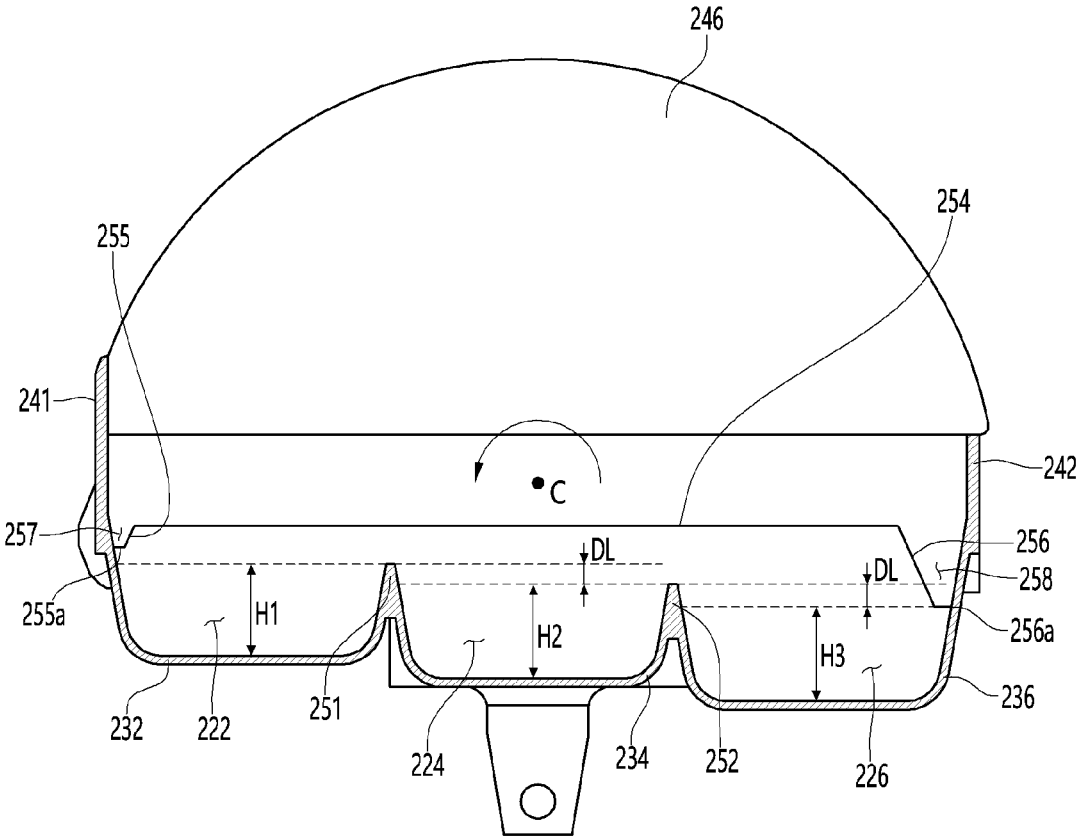
FIG. 8 is a cross-sectional view taken along line 8-8 of FIG. 7.
Figure 9:
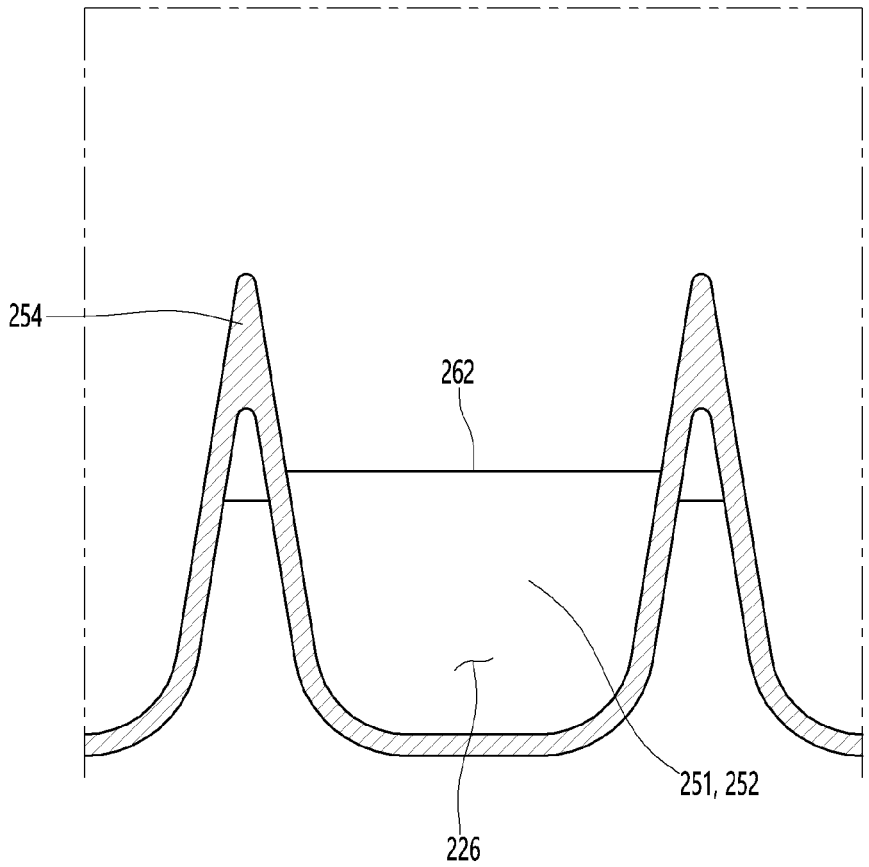
FIG. 9 is a cross-sectional view taken along line 9-9 of FIG. 7.

FIG. 7 is a plan view of the ice tray according to the first embodiment of the present invention, FIG. 8 is a cross-sectional view taken along line 8-8 of FIG. 7, and FIG. 9 is a cross-sectional view taken along line 9-9 of FIG. 7.

Referring to FIGS. 7 to 9, the ice tray 200 according to the present embodiment may include a plurality of ice-making cells 220 that make ice.

The plurality of ice-making cells 220 may be arranged in a first direction (X-axis direction in FIG. 7) and in a second direction (Y-axis direction in FIG. 7) crossing the first direction. In the ice tray 200, the shaft 202 may extend in a direction parallel to the first direction.

In the present embodiment, the ice-making cells arranged in the first direction may be referred to as a "column". In the present embodiment, the ice-making cell 200 may include first to third columns 212, 214, and 216.

The first column 212 may include a plurality of first ice-making cells 222. The second column 214 may include a plurality of second ice-making cells 224. The third column 216 may include a plurality of third ice-making cells 226.

The ice tray 200 may include a first wall 232 that defines the first ice-making cell 222, a second wall 234 that defines the second ice-making cell 224, and a third wall 236 that defines the third ice-making cells 226. The second wall 234 may be disposed between the first wall 232 and the third wall 236.

The first wall 232 may be connected to the second wall 234 by a first connection portion 251. The second wall 234 and the third wall 236 may be connected to each other by a second connection portion 252.

In the present embodiment, the first to third walls 232, 234, and 236 may have bottom surfaces having different heights so that water supplied from the water supply portion 156 is distributed to the first to third ice-making cells 222, 224, and 226 without a water channel.

For example, the height of the bottom surface of the first wall 232 and the bottom surface of the second wall 234 may be different from each other. The bottom surface of the third wall 236 may have a height different from that of each of the bottom surface of the first wall 232 and the bottom surface of the second wall 234.

The bottom surface of the second wall 234 may be disposed lower than the bottom surface of the first wall 232. The bottom surface of the third wall 236 may be disposed lower than the bottom surface of the second wall 234.

The first to third ice-making cells 222, 224, and 226 may have the same or different shapes and sizes depending on the amount of water supplied to the ice tray 200.

Hereinafter, a case in which the shapes and sizes of the first to third ice-making cells 222, 224, and 226 are substantially the same will be described.

In the present embodiment, the "substantially the same" means that the sizes and shapes are almost similar to each other as well as the case the sizes and shapes are completely the same.

To allow the sizes of the ice made in the ice-making cell to be substantially the same, reference water levels H1, H2, and H3 at the bottom surface of the respective walls 232, 234, and 236 that are capable of being filled with water may be set to be the same. However, after the water supply is completed, an actual water level of each ice-making cell may be different from the reference water level, but may be substantially similar to the reference water level.

The first reference water level H1 at the bottom surface of the first wall 232 may be disposed equal to or lower than the height of the first connection portion 251. FIG. 8 illustrates that the first reference water level H1 is the same as the height of the first connection portion 251.

The second reference water level H2 at the bottom surface of the second wall 234 that is capable of being filled with water may be lower than the height of the first connection portion 251 and may be equal to or lower than the height of the second connection portion 252. For example, FIG. 8 illustrates that the second reference water level H2 is the same as the height of the second connection portion 252.

The second reference water level H3 at the bottom surface of the third wall 236 may be lower than the height of the second connection portion 252.

A height difference DL between the first reference water level H1 of the first wall 232 and the second reference water level H2 of the second wall 234 may be the same as a height difference DL between the second reference water level H2 of the second wall 234 and the third reference water level H3 of the third wall 236.

An upper end of the second connection portion 252 may be disposed lower than an upper end of the first connection portion 251.

The ice tray 200 may further include partition walls 254 that partitions the ice-making cells 222, 224, and 226 in each of the columns 212, 214, and 216. An upper end of the partition wall 254 may be disposed higher than each of the first connection portion 251 and the second connection portion 252.

The upper end of the partition wall 254 may be disposed lower than each of the upper ends of the first blocking wall 241 and the second blocking wall 242 to be described later.

For example, one partition wall 254 may serve as a common partition wall in each column. That is, the partition wall 254 may extend in the Y-axis direction and may have one side connected to the first wall 232 and the other side connected to the third wall 236.

The one side of the partition wall 254 may include a first side surface 255. The first side surface 255 may be spaced apart from the first wall 232. The first side surface 255 may be inclined downward toward the first wall 232. A lower end of the first side surface 255 may be connected to the first wall 232 by a first connection surface 255*a*. The first connection surface 255*a* may be disposed lower than an upper end of the partition wall 254 and may be disposed higher than an upper end of the first connection portion 251. Thus, a first passage 257 may be defined by the first side surface 255, the first wall 232, and the first connection surface 255*a*.

The other side of the partition wall 254 may include a second side surface 256. The second side surface 256 may be spaced apart from the third wall 236. The second side surface 256 may be inclined downward toward the third wall 236. A lower end of the second side surface 256 may be connected to the third wall 236 by a second connection surface 256*a*. The second connection surface 256*a* may be disposed lower than the upper end of the partition wall 254 and may be disposed lower than the upper end of the second connection portion 252. For example, the second connection surface 256*a* may be set to be equal to or higher than the third reference water level H3 of the third wall 236.

Thus, the second passage 258 may be defined by the second side surface 256, the second wall 236, and the second connection surface 256*a*.

As another example, three partition walls may partition the ice-making cells 222, 224, and 226 in each column.

The water falling from the water supply portion 156 may be supplied to the ice-making cell in any one column of the first to third columns 212, 214, and 216. The water supplied to a particular ice-making cell may be distributed to adjacent ice-making cells in a particular column.

Referring to FIG. 8, a blocking wall 246 may be provided at at least one side of the ice tray 200 to prevent the water from overflowing.

A first blocking wall 241 may be provided at an opposite side of the first connection portion 251 on the first wall 232 of the ice tray 200. The first blocking wall 241 may extend upward from the first wall 232. An upper end of the first blocking wall 241 may be disposed higher than a rotational center C of the ice tray 200. The upper end of the first blocking wall 241 may be disposed higher than the first connection portion 251. The upper end of the first blocking wall 241 may be disposed higher than the partition wall 254.

A second blocking wall 242 may be provided on the third wall 236 of the ice tray 200 at a side opposite to the second connection portion 252. The second blocking wall 242 may extend upward from the third wall 236. An upper end of the second blocking wall 242 may be disposed higher than the rotational center C of the ice tray 200. The upper end of the second blocking wall 242 may be disposed higher than each of the first and second connection portions 251 and 252. The upper end of the second blocking wall 242 may be disposed higher than the partition wall 254.

Top surfaces 262 of the first and second connectors 251 and 252 may extend in a straight line in the arrangement direction of the ice-making cells in each column.

In the present embodiment, after the ice making of the ice tray 200 is completed, the ice tray 200 may be rotated in a counterclockwise direction in FIG. 8.

After the water is supplied to the ice tray 200, the ice tray 200 may be rotated in the counterclockwise direction before the ice making so that the water is evenly distributed to the ice-making cells 222, 224, and 226.

When the ice tray 200 is rotated in the counterclockwise direction, the bottom surface of the first wall 232 may be lowered, and the bottom surface of the third wall 236 may be raised. In this case, the water in the third ice-making cell 226 may move to the second ice-making cell 224, and the water in the second ice-making cell 224 may move to the first ice-making cell 222.

Thus, the upper end of the first blocking wall 241 may be disposed higher than the second blocking wall 242 to prevent the water from overflowing from a side of the first blocking wall 241 while the ice tray 200 is rotated.

Figure 10:
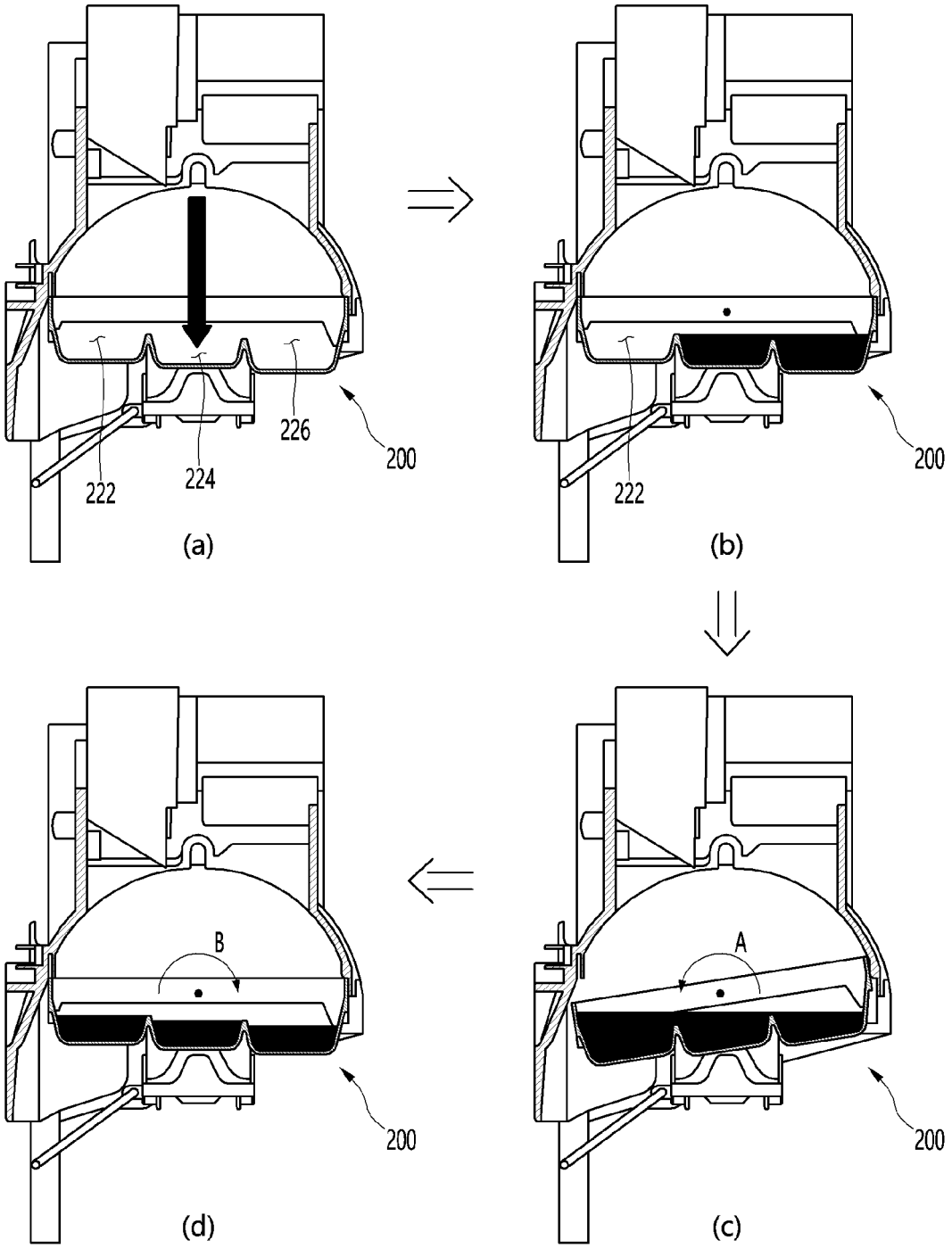
FIG. 10 is a view for explaining a method for controlling an ice tray, which distributes water supplied to the ice tray into each of ice-making cells.
Figure 11:
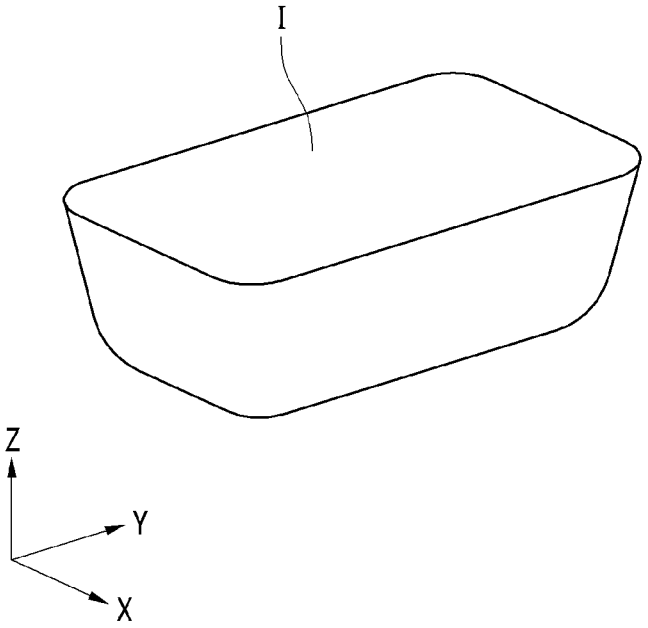
FIG. 11 is a view illustrating ice made in the ice tray according to the first embodiment of the present invention.
Figure 12:
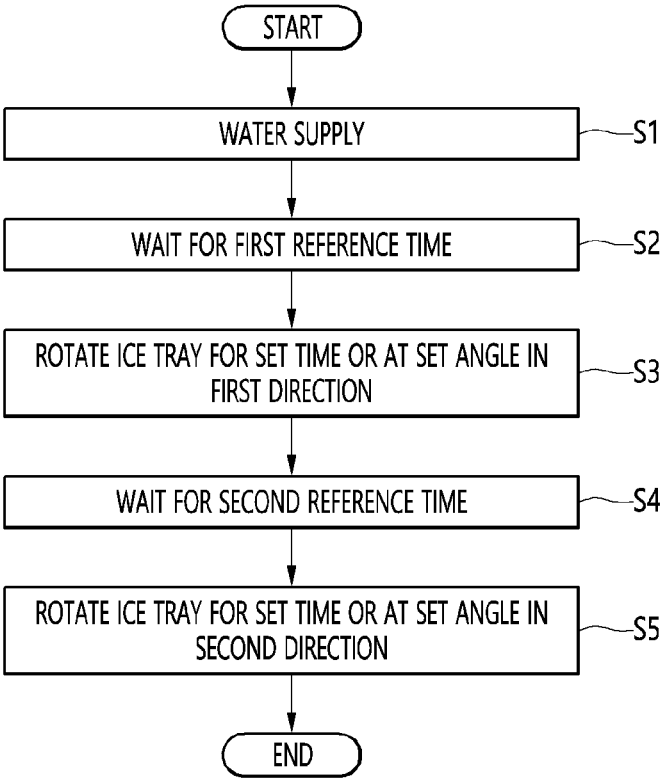
FIG. 12 is a view for explaining a method for controlling the refrigerator according to the first embodiment of the present invention.

FIG. 10 is a view for explaining a method for controlling an ice tray, which distributes water supplied to the ice tray into each of ice-making cells, and FIG. 11 is a view illustrating ice made in the ice tray according to the first embodiment of the present invention. FIG. 12 is a view for explaining a method for controlling the refrigerator according to the first embodiment of the present invention.

(a) of FIG. 10 is a view illustrating a water supply process, (b) of FIG. 10 is a view illustrating an ice tray that is in a state in which water supply is completed, (c) of FIG. 10 is a view illustrating a state in which the ice tray is rotated in a forward direction to distribute water, and (d) of FIG. 10 is a view illustrating a state in which the ice tray is rotated in a reverse direction to return to an original position.

Referring to FIGS. 6, 7, 10, 11, and 12, a method for controlling a refrigerator according to the present embodiment may include a water supply process (S1).

For example, the water may be supplied to an ice-making cell in a specific column through a water supply portion 156. For example, FIG. 10 illustrates that water is supplied to a second column 214 at an initial position of an ice tray 200. Alternatively, water may be supplied to a first column 212 or a third column 216.

First, referring to (a) and (b) of FIG. 10, when water is supplied to the specific second ice-making cell 224 in the second column 214, the supplied water may overflow to move to the third column 216. That is, the water overflowing from the specific second ice-making cell 224 moves to a specific third ice-making cell 226 adjacent to the specific second ice-making cell 224.

The water moving to the specific third ice-making cell 226 may be distributed to the adjacent third ice-making cell 226. For example, the water moved to the specific third ice-making cell 226 may be distributed to the adjacent third ice-making cell 226 through the second passage 258.

After the water is distributed to the plurality of third ice-making cells 226 as a whole, a water level in the third ice-making cells 226 may increase so that the water level is higher than a height of the second connection portion 252.

To distribute the water to the plurality of third ice-making cells 226 as a whole during the water supply process, the method for controlling the refrigerator according to the present embodiment may further include a waiting process (S2) for a first reference time.

The method for controlling the refrigerator according to the present embodiment may further include a rotation process (S3) of rotating the ice tray 200 to distribute water.

When the first reference time elapses after the water supply is completed, the ice tray 200 may be rotated at a set angle or for a set time in a forward direction (direction A in FIG. 10, or the first direction) by a driving portion 158 so that the water is distributed to the first column 212.

When the ice tray 200 is rotated for the set time, the ice tray 200 may be rotated at the set angle. The set time may be shorter than the first reference time.

The set angle may be set to the extent that the water in the second column 214 and the third column 216 overflows over the first connection portion 251, and the water moving to the first column 212 does not overflow over the first blocking wall 241.

The set angle may be set to the extent that the water moving to the first column 212 is distributed to a plurality of first ice-making cells 222 through a first passage 257.

Although not limited, the set angle may be about 10 degrees or more and about 20 degrees or less.

As illustrated in (c) of FIG. 10, when the ice tray 200 is rotated in the forward direction, a portion of the water in the second column 214 may move to the first column 212, and a portion of the water in the third column 216 may move to the second column 214.

The set angle may be set so that when the ice tray 200 is rotated in the forward direction, a level of the entire water in the ice tray 200 is higher than a height of each of the first connection portion 251, the second connection portion 252, and the first passage 257.

In this case, the water moving to the specific first ice-making cell 222 in the first column 212 may be distributed to the adjacent first ice-making cell 222 through the first passage 257, and thus, the water may be evenly filled in the plurality of first ice-making cells 222 in the first column 212. In addition, the plurality of second ice-making cells 224 in the second column 214 may be evenly filled with water.

The method for controlling the refrigerator according to the present embodiment may include a waiting process (S4) for a second reference time after the ice tray 200 is rotated in the forward direction to evenly distribute the water to the plurality of first ice-making cells 222 in the first column 212. The first reference time may be the same as or different from the second reference time.

The method for controlling the refrigerator according to the present embodiment may further include a process (S5) of rotating the ice tray 200 in a reverse direction to return to an initial position.

That is, after the lapse of the second reference time, the ice tray 200 may be rotated by the driving portion 158 in the reverse direction (direction B in FIG. 10, or the second direction) at the set angle or for the set time.

As illustrated in (c) of FIG. 10, when the ice tray 200 is rotated at the set angle, the total level of the water may be higher than the height of each of the first connection portion 251 and the second connection portion 252. In this state, when the ice tray 200 is rotated in the reverse direction, a portion of the water may move toward the third row 216 as illustrated in (d) of FIG. 10 and then be evenly filled with water.

The processes (S4 to S5) may be performed at least twice so that the water is evenly distributed to all the ice-making cells 222, 224, and 226.

In the state as illustrated in (d) of FIG. 10, ice making may start.

When it is determined that the ice making is completed after the ice making starts, the ice separation may start. Although not limited, a heater for separating ice may be provided at a lower side of the ice tray 200. The heater for separating the ice may be stopped after operating for a set time. The heater for separating the ice may help the ice to be separated from the ice tray 200.

For the ice separation, the ice tray 200 may be rotated forward at an angle for separating the ice by the driving portion 158. Although not limiting, the angle for separating the ice may be greater than about 120 degrees. As the ice tray 200 is rotated in the forward direction, the ice tray may be deformed (changed in a twisting manner) so that the ice is separated from the ice tray 200 to fall downward.

Referring to FIG. 11, ice I may be made to have a horizontal length (length in the X-axis direction) and a vertical length (length in the Y-axis direction), which are different from each other. In the present embodiment, since three columns of ice-making cells are formed in the ice tray 200, a size of the ice I may be reduced. As the size of the ice I decreases, the horizontal and vertical lengths of the ice I may vary.

When the size of the ice is reduced, not only an ice-making speed may be increased, but also a contact area between the ice I and the ice tray 200 may be reduced, and thus, the ice may be removed smoothly. In addition, since there is no water channel for the movement of water between the columns, the ice made in each column may not be connected to the ice in the adjacent column, and thus, the ice may be smoothly separated.

In addition, the second passage 258 may enable the movement of the water in the adjacent third ice-making cells 226, but the second connection surface 256*a* may have a level equal to or higher than the third reference water level H3 of the third ice-making cell 226. As a result, the ice made in the plurality of ice-making cells may not be connected to each other, and thus, the ice may be smoothly separated.

A height (length in the Z-axis direction) of the ice made in the first ice-making cell 222 may be the same as a height from the bottom surface of the first wall 232 to the first connection portion 251. A height of the ice made in the second ice-making cell 224 may be the same as that from the bottom surface of the second wall 234 to the second connection portion 252. A height of the ice made in the third ice-making cell 226 may be the same as that from the bottom surface of the third wall 236 to the second connection surface 256*a*. However, the height of the ice made in the third ice-making cell 226 may be the same as or different from the height of the ice made in the first ice-making cell 222 or the second ice-making cell 224.

As another example, a water supply portion 156 may be disposed to supply water to a specific first ice-making cell 222 in the first column 212.

In this case, the water supplied to the specific first ice-making cell 222 may overflow from the specific first ice-making cell 222 to move to the specific second ice-making cell 224 adjacent to the specific first ice-making cell.

The water moving to the specific second ice-making cell 224 may overflow from the specific second ice-making cell 224 to move to the specific third ice-making cell 226 adjacent to the second ice-making cell. After moving to the specific third ice-making cell 226, the water may be distributed to the adjacent third ice-making cell 226 through the second passage 258. Thereafter, the ice tray 200 may be rotated in the forward direction and then the reverse direction as described in FIG. 10 for the overall distribution of the water.

According to the present embodiment, there is an advantage in that water is evenly distributed to the plurality of ice-making cells without the water channel in the ice tray.

In addition, even if the refrigerator is installed in an inclined state, there is an advantage in that the water is evenly distributed to the plurality of ice-making cells by rotating the ice tray after supplying the water.

Figure 13:
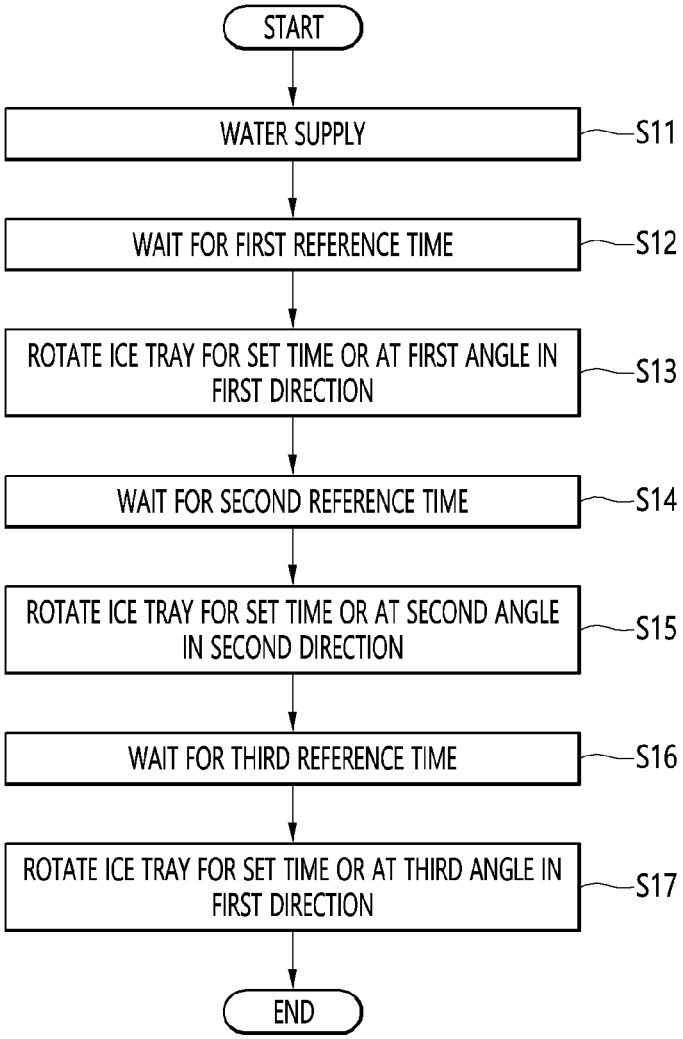
FIG. 13 is a view for explaining a method for controlling a refrigerator according to a second embodiment of the present invention.

FIG. 13 is a view for explaining a method for controlling a refrigerator according to a second embodiment of the present invention.

A structure of an ice tray according to the present embodiment is the same as that according to the first embodiment, except that there is a difference in a method for rotating the ice tray for water distribution. Thus, only characterized portions in the present embodiment will be described below.

Referring to FIG. 13, a method for controlling a refrigerator according to the present embodiment may include a water supply process (S11). For example, water may be supplied in a specific column through a water supply portion 156.

An example of supplying water to a second column 214 of the ice tray 200 at an initial position as in the forgoing embodiment will be described.

When water is supplied to the specific second ice-making cell 224 in the second column 214, the supplied water may overflow from the specific second ice-making cell 224 to move to a third column 216. That is, the water overflowing from the specific second ice-making cell 224 moves to a specific third ice-making cell 226 adjacent to the specific second ice-making cell 224.

The water moving to the specific third ice-making cell 226 may be distributed to the adjacent third ice-making cell 226. For example, the water moved to the specific third ice-making cell 226 may be distributed to the adjacent third ice-making cell 226 through the second passage 258.

After the water is distributed to the plurality of third ice-making cells 226 as a whole, a water level in the third ice-making cells 226 may increase so that the water level is higher than a height of the second connection portion 252.

To distribute the water to the plurality of third ice-making cells 226 during the water supply process, the method for controlling the refrigerator according to the present embodiment may further include a waiting process (S12) for a first reference time.

To distribute the water to the plurality of third ice-making cells 226 as a whole during the water supply process, the method for controlling the refrigerator according to the present embodiment may further include a process (S13) of rotating the ice tray 200 at a first angle (S13) in a first direction.

In the present embodiment, the first direction may be a clockwise direction in FIG. 10.

When the ice tray 200 is rotated in the first direction, a bottom surface of the third wall 236 may be lowered, and the bottom surface of the first wall 232 may be raised. Thus, the first angle may be set to the extent that water does not overflow over a second blocking wall 242.

The first angle may be determined by an angle control or a time control of a driving portion 158.

The control method according to the present embodiment may further include a waiting process (S14) for a second reference time after the ice tray 200 is rotated at the first angle.

The method for controlling the refrigerator according to the present embodiment may further include a process (S15) of rotating the ice tray 200 at a second angle in a second direction opposite to the first direction to distribute water.

When the second reference time elapses, the ice tray 200 may be rotated at the second angle in the second direction by the driving portion 158 so that the water is distributed to the first column 212. The second angle may be set to be greater than the first angle.

In the process of rotating the ice tray 250 at the second angle, the ice tray 250 passes an initial position.

The second angle may be set to the extent that the water in the second column 214 and the third column 216 overflows over the first connection portion 251, and the water moving to the first column 212 does not overflow over the first blocking wall 241.

The second angle may be set to the extent that the water moving to the first column 212 is distributed to a plurality of first ice-making cells 222 through a first passage 257.

In the present embodiment, the difference between the second angle and the first angle may be the same as the set angle of the foregoing embodiment. On the other hand, the first angle may be set to be less than the set angle according to the foregoing embodiment.

When the ice tray 200 is rotated in the second direction, a portion of the water in the second column 214 may move to the first column 212, and a portion of the water in the third column 216 may move to the second column 214.

The second angle may be set so that when the ice tray 200 is rotated in the forward direction, a level of the entire water in the ice tray 200 is higher than a height of each of the first connection portion 251, the second connection portion 252, and the first passage 257.

In this case, the water moving to the specific first ice-making cell 222 in the first column 212 may be distributed to the adjacent first ice-making cell 222 through the first passage 257, and thus, the water may be evenly filled in the plurality of first ice-making cells 222 in the first column 212. In addition, the plurality of second ice-making cells 224 in the second column 214 may be evenly filled with water.

The method for controlling the refrigerator according to the present embodiment may include a waiting process (S16) for a third reference time after the ice tray 200 is rotated in the second direction to evenly distribute the water to the plurality of first ice-making cells 222 in the first column 212. The first reference time may be the same as or different from the third reference time.

The method for controlling the refrigerator according to the present embodiment may further include a process (S17) of rotating the ice tray 200 at a third angle in the first direction. That is, the method for controlling the refrigerator according to the present embodiment may further include a process of allowing the ice tray 200 to return to an initial position.

Here, the third angle is equal to the difference between the second angle and the first angle.

After the lapse of the third reference time, the ice tray 200 may be rotated at the third angle in the first direction by the driving portion 158.

When the ice tray 200 is rotated at the second angle, the total water level is higher than a height of each of the first connection portion 251 and the second connection portion 252. Therefore, in this state, when the ice tray 200 is rotated again in the first direction, a portion of the water may move toward the third column 216, and thus, the water may be evenly filled into the plurality of third ice-making cells 226 in the third column 216.

The processes (S13 to S17) may be performed at least twice so that the water is evenly distributed to all the ice-making cells 222, 224, and 226. The ice making may start after the process (S17) is completed.

In the present embodiment, the order of the process (S13) and process (S15) may be mutually changed. That is, after the ice tray 200 is rotated at the first angle in the second direction, the ice tray 200 may be rotated at the second angle in the first direction. Then, the ice tray 200 may be rotated at the third angle to return to the initial position.

Figure 14:
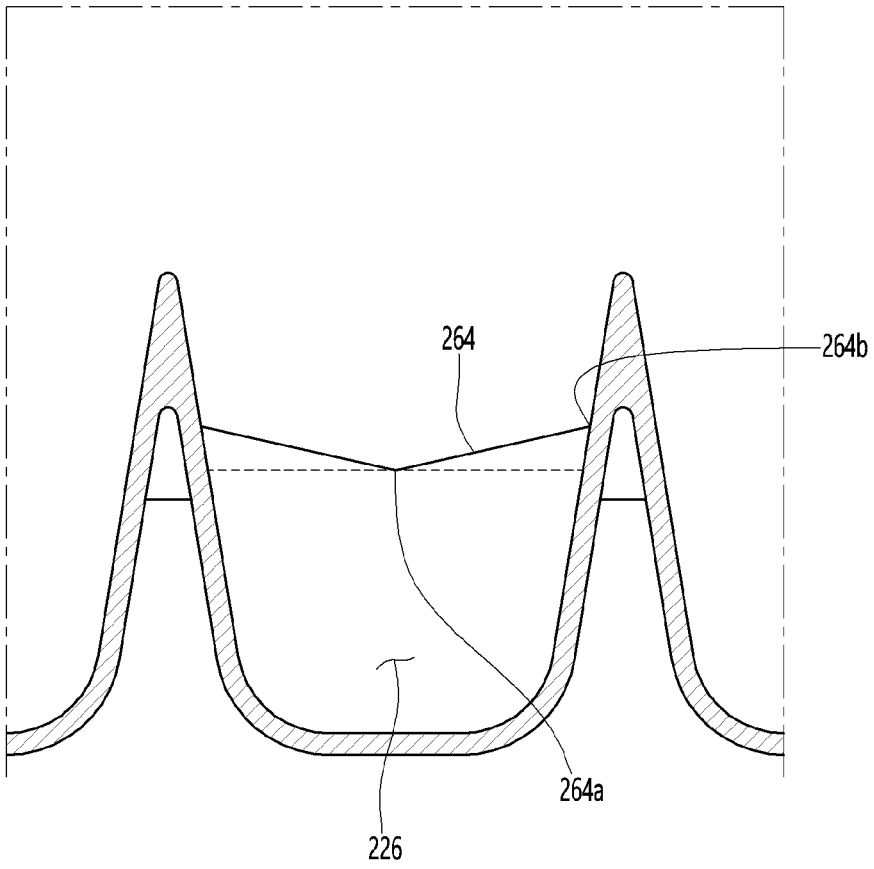
FIG. 14 is a view taken along line 9-9 of FIG. 7 according to a third embodiment of the present invention.
Figure 15:
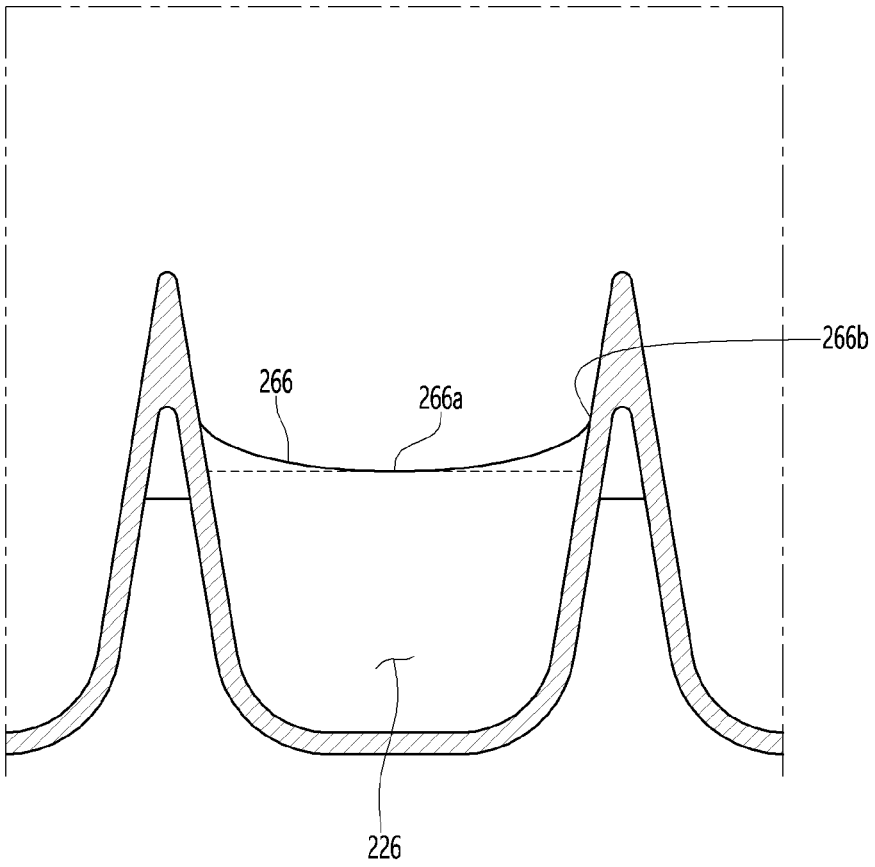
FIG. 15 is a view taken along line 9-9 of FIG. 7 according to a fourth embodiment of the present invention.

FIG. 14 is a view taken along line 9-9 of FIG. 7 according to a third embodiment of the present invention. FIG. 15 is a view taken along line 9-9 of FIG. 7 according to a fourth embodiment of the present invention.

First, referring to FIG. 14, a central portion of a top surfaces 264 of each of first and second connection portions 251 and 252 may be disposed lower than each of both ends of the top surface 264 so that water smoothly move to adjacent columns during rotation of an ice tray 200 for water distribution.

For example, the top surface 264 of each of the first and second connection portions 251 and 252 may be inclined upward from the central portion 264*a* to each of both the ends 264*b* in an arrangement direction of ice-making cells in each column. The top surface 264 of each of the first and second connection portions 251 and 252 may be inclined upward in a straight line from the central portion 264*a* to each of both the ends 264*a*.

Alternatively, referring to FIG. 15, the top surface 266 of each of the first and second connection portions 251 and 252 may have a central portion lower than each of both the ends. For example, the top surface 266 of each of the first and second connection portions 251 and 252 may be inclined upward from the central portion 266*a* to each of both the ends 266*b*. In this case, the top surface 266 of each of the first and second connection portions 251 and 252 may extend from the central portion 266*a* to each of both the ends 266*b* in a rounded shape.

Each of the central portions 264*a* and 266*a* on the top surfaces 264 and 266 of the first and second connection portions 251 and 252 may be disposed at the same height as a reference water level of the ice-making cell.

As described above, when the central portion on each of the top surfaces 264 and 266 of the first and second connection portions 251 and 252 is disposed lower than each of both the ends, surface tension of water may be reduced, and thus, the water may smoothly overflow over each of the connection portions 251 and 256.

The invention claimed is:

1. A refrigerator comprising:

a cabinet defining a storage compartment;

a door configured to open and close the storage compartment; and an ice maker wherein the ice maker comprises an ice tray including a plurality of ice-making cells configured to make ice, wherein the ice tray positions the plurality of ice-making cells into a plurality of columns, each of the plurality of columns includes two or more of the ice-making cells of the plurality of ice-making cells, wherein the plurality of ice-making cells include a first ice-making cell, and a second ice-making cell that is adjacent to the first ice-making cell, wherein the ice tray comprises:

a first wall configured to define the first ice-making cell, a second wall configured to define the second ice-making cell, a bottom surface of the second wall being lower than a bottom surface of the first wall, a first connection wall configured to connect the first wall to the second wall, and a partition wall configured to partition pairs of adjacent ice-making cells of the first ice making cell, and wherein an upper end of the partition wall is higher than an upper end of the first connection wall and a distance from the upper end of the partition wall to the bottom surface of the second ice-making cell is greater than a maximum distance from the upper end of the partition wall to the bottom surface of the first ice-making cell.

2. The refrigerator according to claim 1, wherein the plurality of ice-making cells further include a third ice-making cell that is adjacent to the second ice-making cell, wherein the ice tray further comprises:

a third wall configured to define the third ice-making cell, wherein the bottom surface of the second wall is lower than the bottom surface of the first wall, and a bottom surface of the third wall is lower than the bottom surface of the second wall.

3. The refrigerator according to claim 2, wherein the ice further tray comprises:

a second connection wall configured to connect the second wall to the third wall.

4. The refrigerator according to claim 3, wherein a height of an upper end of the second connection wall is less than a height of an upper end of the first connection wall.

5. The refrigerator according to claim 3, wherein a height of ice made in the first ice-making cell matches at least one of:

a height from the bottom surface of the first wall to the first connection wall; or a height from the bottom surface of the second wall to the second connection wall.

6. The refrigerator according to claim 3, wherein the partition wall is configured to partition pairs of adjacent ice-making cells of the second ice-making cell and pairs of the adjacent ice-making cells of the third ice-making cell, and wherein the upper end of the partition wall is higher than an upper end of the second connection wall and a distance from the upper end of the partition wall to the second connection wall is greater than a distance from the upper end of the partition wall to the first connection wall.

7. The refrigerator according to claim 3, wherein, in an arrangement direction of the plurality of ice-making cells in each of the plurality of columns, each of top surfaces of the first connection wall and the second connection wall is provided in a straight-line shape, or a central portion of each of the top surfaces of the first connection wall and the second connection wall is positioned lower than each of both ends of the top surfaces of the first connection wall and the second connection wall.

8. The refrigerator according to claim 6, wherein a first side of the partition wall comprises a first side surface that is spaced apart from the first wall, wherein a lower end of the first side surface is connected to the first wall by the first connection surface, and wherein the first side surface, the first wall, and the first connection surface are configured to define a first passage.

9. The refrigerator according to claim 6, wherein a second side of the partition wall comprises a second side surface that is spaced apart from the third wall, wherein a lower end of the second side surface is connected to the third wall by a second connection surface, and wherein the second side surface, the third wall, and the second connection surface are configured to define a second passage.

10. The refrigerator according to claim 6, further comprising:

a first blocking wall extending upward from an opposite side of the first connection wall on the first wall; and a second blocking wall extending upward from an opposite side of the second connection wall on the third wall, wherein a height of an upper end of the first blocking wall is greater than a height of an upper end of the second blocking wall.

11. The refrigerator according to claim 8, wherein the first connection wall is positioned lower than the upper end of the partition wall and is positioned higher than the upper end of the second connection wall.

12. The refrigerator according to claim 9, wherein the second connection surface is positioned lower than the upper end of the second connection wall.

13. The refrigerator according to claim 10, wherein the upper ends of each of the first blocking wall and the second blocking wall are higher than the upper end of the partition wall.

14. A refrigerator comprising:

a cabinet defining a storage compartment;

a door configured to open and close the storage compartment; and an ice maker wherein the ice maker comprises an ice tray including a plurality of ice-making cells configured to make ice, wherein the ice tray positions the plurality of ice-making cells into a plurality of columns, each of the plurality of columns includes two or more of the ice-making cells of the plurality of ice-making cells, wherein the plurality of ice-making cells include a first ice-making cell, and a second ice-making cell that is adjacent to the first ice-making cell, wherein the ice tray comprises:

a first wall configured to define the first ice-making cell, a second wall configured to define the second ice-making cell, a bottom surface of the second wall being lower than a bottom surface of the first wall, a first connection wall configured to connect the first wall to the second wall, and a common partition wall configured to partition pairs of adjacent ice-making cells of the first ice-making cell and pairs of adjacent ice-making cells of the second ice-making cell, and wherein a distance from an upper end of the common partition wall to the bottom surface of the second ice-making cell is greater than a maximum distance from the upper end of the common partition wall to the bottom surface of the first icemaking cell.

15. The refrigerator according to claim 14, wherein a portion of the common partition wall is connected to the first wall and another portion of the common partition wall is connected to the second wall.

16. The refrigerator according to claim 14, wherein the ice tray further comprises:

a third wall configured to define a third ice-making cell, a second connection wall configured to connect the first wall to the second wall, and wherein a portion of the common partition wall is connected to the first wall and another portion of the common partition wall is connected to the third wall.

17. The refrigerator according to claim 14, wherein the common partition wall includes a passage to distribute water between adjacent ice-making cells of the first ice-making cell, and the passage has a portion disposed higher than the first connection wall.

18. The refrigerator according to claim 16, wherein the common partition wall includes a passage to distribute water between adjacent ice-making cells of the third ice-making cell, and the passage has a portion disposed higher than the second connection wall.

19. A refrigerator comprising:

a cabinet defining a storage compartment;

a door configured to open and close the storage compartment; and an ice maker wherein the ice maker comprises an ice tray including a plurality of ice-making cells configured to make ice, and wherein the ice tray positions the plurality of ice-making cells into a plurality of columns, each of the plurality of columns includes two or more of the ice-making cells of the plurality of ice-making cells, wherein the plurality of ice-making cells include a first ice-making cell, a second ice-making cell that is adjacent to the first ice-making cell, wherein the ice tray comprises:

a first wall configured to define the first ice-making cell, a second wall configured to define the second ice-making cell, a bottom surface of the second wall being lower than a bottom surface of the first wall, a first connection wall configured to connect the first wall to the second wall, and a partition wall configured to partition pairs of adjacent ice-making cells of the first ice-making cell, wherein the partition wall includes a passage to distribute water between adjacent ice-making cells of the first ice-making cell, and wherein the passage has a portion disposed higher than the first connection wall and an upper end of the partition wall is higher than an upper end of the first connection wall and a distance from the upper end of the partition wall to the bottom surface of the second ice-making cell is greater than a maximum distance from the upper end of the partition wall to the bottom surface of the first ice-making cell.

20. The refrigerator according to claim 19, wherein the ice tray further comprises:

a third wall configured to define the third ice-making cell, a second connection wall configured to connect the first wall to the second wall, and wherein the partition wall further includes an additional passage to distribute water between adjacent ice-making cells of the third ice-making cell, and the additional passage has a portion disposed higher than the first connection wall.

* * * * *